United States Patent [19]

Higashinakagawa et al.

[11] Patent Number: 4,846,747

[45] Date of Patent: Jul. 11, 1989

[54] SHADOW MASK, AND METHOD OF MANUFACTURING THE SAME

[75] Inventors: Emiko Higashinakagawa, Kawasaki; Yasuhisa Ohtake, Fukaya; Masaharu Kanto, Hyogo; Fumio Mori, Yokohama, all of Japan

[73] Assignee: Kabushiki Kaisha Toshiba, Kawasaki, Japan

[21] Appl. No.: 281,868

[22] Filed: Dec. 8, 1988

Related U.S. Application Data

[63] Continuation of Ser. No. 69,230, Jul. 2, 1987, abandoned.

[30] Foreign Application Priority Data

Jul. 4, 1986 [JP] Japan ..... 61-157292

[51] Int. Cl.[4] ..... H01J 9/00; H01J 29/07

[52] U.S. Cl. ..... 445/47; 72/347; 313/402

[58] Field of Search ..... 445/37, 47; 72/347; 313/402

[56] References Cited

U.S. PATENT DOCUMENTS

| | | | |
|---|---|---|---|
| 4,072,876 | 2/1978 | Morrell | 313/403 |
| 4,427,396 | 1/1984 | van den Berg | 445/47 |
| 4,528,246 | 7/1985 | Higashinakagawa | 148/11.5 R |

FOREIGN PATENT DOCUMENTS

| | | | |
|---|---|---|---|
| 148341 | 11/1980 | Japan | 445/47 |
| 59-101743 | 6/1984 | Japan . | |
| 2177627 | 1/1987 | United Kingdom | 445/47 |

*Primary Examiner*—Kenneth J. Ramsey

*Attorney, Agent, or Firm*—Oblon, Spivak, McClelland, Maier & Neustadt

[57] ABSTRACT

An ingot of an Invar alloy is rolled in one direction into a plate, a number of slot holes are formed in this plate, and the plate is pressed into a curved form, thus providing a shadow mask of a color CRT. The slot holes of this shadow mask have longitudinal axes extending substantially at right angles to the rolling direction of the plate. The holes maintain their shapes after the plate has been pressed.

20 Claims, 4 Drawing Sheets

SHADOW MASK, AND METHOD OF MANUFACTURING THE SAME

This application is a continuation of application Ser. No. 069,230, filed on July 2, 1987, now abandoned.

BACKGROUND OF THE INVENTION

This invention relates to a shadow mask of a color cathode ray tube (CRT), and also a method of manufacturing the shadow mask.

Recently it has been increasingly demanded that a television screen provide comfortable viewing. ("Comfortable viewing" is a term of art referring in part to the ability to discern fine characters and images on the screen, i.e., high resolution, and in part to a brighter picture produced by increasing beam current.) Therefore, it is now necessary to enhance the resolution of a CRT. In order to provide a CRT of high resolution, the shadow mask of the CRT must have smaller beam-guiding holes in greater numbers, which are arranged in a higher density.

In a color CRT, a shadow mask is provided near the tricolor fluorescent screen located inside the front end element of the CRT. The electron beams emitted from the electron guns pass through the beam-guiding holes cut in the shadow mask, and are applied to the tricolor fluorescent screen. To apply the electron beams to accurate positions on the fluorescent screen, thereby to form high-quality images, it is necessary to cut beam-guiding holes in a metal plate with a high precision, so that the holes take accurate positions and have desired diameter and shape. Further, in order to balance the size of the image formed on the center of the screen with the size of the image formed on the peripheral portion of the screen, the shadow mask must be pressed to have its peripheral edges curved with a predetermined curvature. If the beam-guiding holes are cut with an insufficient precision, or if the shadow mask is pressed into an unaccurate curved form, the beam-guiding holes will not be aligned with the positions at which the electron beams should fall on the fluorescent screen. Consequently, a phenomenon called "doming" will occur, inevitably deteriorating the quality of the image formed on the screen.

Generally, a shadow mask is manufactured in the following way. First, an ingot is hot-rolled, then cold-rolled into a thin, band-link sheet. Thereafter, a number of elongated holes are perforated in the sheet by means of etching. A rectangular shadow mask plate having a desired area is cut out of the band-like sheet.

Hitherto, the cutting plan of the shadow mask plate is laid out such that the short sides of the rectangular plate extend in the cold-rolling direction of the band-like sheet. The elongated holes are so arranged that they are parallel to the short sides of the shadow mask plate. Hence, the longitudinal axes of the elongated holes are parallel to the rolling direction of the band-like sheet. After the elongated holes have been cut by etching, the shadow mask plate is pressed into a desired shape.

Most shadow masks are made of aluminum-killed steel. This is because this material is easy to etch and shape. Another reason is that an oxide layer, which reduces the reflection of electron beams, can easily coated on a plate made of a aluminum-killed steel.

However, aluminum-killed steel has a relatively great coefficient of thermal expansion. When a shadow mask made of aluminum-killed steel and having tiny and densely arranged holes is heated due to the application of electron beams, it expands, thus deforming the holes, and ultimately giving rise to a local doming.

In view of this, it has recently been proposed that a shadow mask having tiny and densely arranged holes be made of Invar alloy having a small coefficient of thermal expansion, in particular, so-called Invar (or Nilvar) alloy, i.e., a 64Fe36Ni alloy. ("Invar" is a trademark with registration Number 63970.)

It is disclosed in U.S. Pat. No. 4,528,246 and U.S. patent application Ser. No. 647,924 now U.S. Pat. No. 4,665,338 that shadow masks are made of Invar alloy. In both cases, use is made of the small coefficient of thermal expansion of this specific alloy, for the purpose of minimizing the expansion of the beam-guiding holes during the use of the shadow mask.

Japanese Patent Disclosure No. 59-101743 also discloses that a shadow mask is made of Invar alloy. This publication further teaches that an Invar alloy sheet expands at the lowest rate in the direction at 45° to the rolling-direction of the sheet. For this reason, the beam-guiding elongated holes of the shadow mask disclosed in this publication are arranged such that their axes extend in the direction at 45° to the rolling direction of the sheet.

Invar alloy has a great 0.2% proof stress (The term "0.2% proof stress" means the nominal stress applied on material, leaving a 0.2% plastic strain in the material). Therefore, when a plate of Invar alloy is pressed, its springback is great. Even if a shadow mask plate is pressed in such a shape as is shown in FIG. 5 under stress, its edge portions will return to their original shape upon release of stress, as is shown by two-dot, one-dash line in FIG. 5. It is difficult to press mask plate 5*a* made of Invar alloy into the desired form shown by solid line in FIG. 5. Thus, it is necessary to anneal the shadow mask plate in vacuum or in a hydrogen atmosphere, thus reducing the 0.2% proof stress of the alloy, before the plate is pressed. Once the plate has been annealed, its springback is minimized, whereby the plate can be easily pressed into the desired form.

However, when the shadow mask plate of Invar alloy is pressed into the curved form (as solid line shown in FIG. 5) after the 0.2% proof stress of the alloy has been minimized, elongated holes 6 of the plate will likely explained along their lateral axes. Hence, as is shown in FIG. 6, the width of each elongated hole 6 increases. Consequently, the dimensional precision of holes 6 is low.

SUMMARY OF THE INVENTION

Accordingly, the object of the present invention is to provide a shadow mask whose beam-guiding holes maintain their shapes after a plate has been pressed, and are small and arranged in a high density, and also to provide a method of manufacturing the shadow mask.

According to an aspect of the present invention, an ingot of a Fe-based alloy of various types having a small thermal expansion coefficient alloy is rolled in one direction into a sheet, a number of elongated holes are formed in this sheet, and the sheet is pressed into a curved form, thus providing a shadow mask. The elongated holes of this shadow mask have longitudinal axes extending substantially at right angles to the rolling direction of the sheet.

The shadow mask is manufactured in the following manner. A number of elongated holes are formed by etching in a rolled sheet made of a Fe-based alloy of various types having a small thermal expansion coefficient alloy, such that the longitudinal axes of the holes extend substantially at right angles to the rolling direction of the sheet. Rectangular shadow mask plates are cut out of the sheet. Each shadow mask plate, which has a predetermined number of elongated holes, is annealed, thus reducing the 0.2% proof stress of a Fe-based alloy of various types having a small thermal expansion coefficient alloy to prevent a springback of the plate. Thereafter, the shadow mask plate is pressed into a desired shape.

Generally, a rolled metal plate does not have a uniform strength in all directions. It is stronger in its rolling direction than in the direction at right angles to the rolling direction. This trend is remarkable for a thin rolled sheet since the thin sheet has been made by rolling an ingot under a high pressure.

The present inventors measured the 0.2% proof stress of shadow mask plates made of an Invar-type alloy. They have found that the plates are stronger in their rolling direction than in the direction (cross direction) at right angles to the rolling direction.

As has been described, the longitudinal axes of the elongated holes of the shadow mask according to this invention extend substantially at right angles to the rolling direction of the shadow mask plate. In other words, the longitudinal axes of the holes, along which the holes are hard to expand, extend in the direction in which the plate has a smaller 0.2% proof stress, whereas the lateral axes of the holes, along which the holes are more likely to expand, extend in the direction in which the plate has a greater 0.2% proof stress. Hence, the plate is stronger along the lateral axes of the holes than along the longitudinal axes of the holes. The elongated holes are, therefore, not deformed when the shadow mask plate is pressed into a curved form, thus providing a shadow mask. The shadow mask thus manufacturing has a minimized springback and beam-guiding holes of a desired shape and size.

DETAILED DESCRIPTION OF THE PREFERRED EMBODIMENT

An embodiment of the present invention will now be described with reference to the accompanying drawings.

Figure 1:
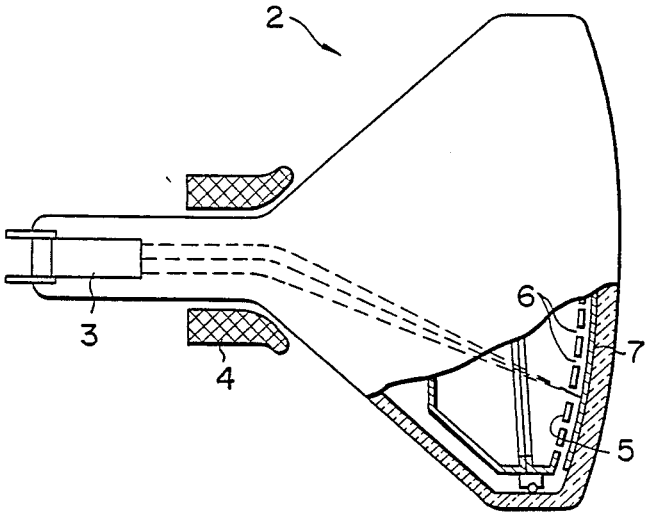
FIG. 1 is a partially cross-sectional view of a color CRT.

As is shown in FIG. 1, a color CRT 2 comprises electron gun assembly 3 for emitting electron beams, yoke 4 for deflecting the electron beams emitted from gun assembly 3, shadow mask 5 having a number of elongated holes 6 for guiding the electron beams, and tricolor fluorescent screen 7 to which the electron beams are applied. Shadow mask 5 is provided between electron gun assembly 3 and fluorescent screen 7. The three electron beams emitted from electron gun assembly 3 are deflected by the magnetism generated by yoke 4, pass through holes 6 of shadow mask 5, and reach tricolor fluorescent screen 7. These three beams fall on a red phosphor dot, a blue phosphor dot, and a green phosphor dot—all formed on screen 7. These phosphor dots thereby emit red light, blue light, and green light, respectively.

Shadow mask 5 has 200,000 to 3,000,000 beam-guiding holes, and these holes are arranged in a high density. The shape and size of these holes, and the positional relationship thereof should remain unchanged. Shadow mask 5 is, therefore, made of a Fe-based alloy of various types having a small thermal expansion coefficient alloy which has a small coefficient of thermal expansion.

A typical example of an Invar-type alloy is Invar (or Nilvar) alloy whose coefficient of thermal expansion is about one tenth of that of steel. Invar alloy consists of 34 to 42% by weight of nickel, 0.8% or less by weight of manganese, 0.8% or less by weight of chromium, 0.5% or less by weight of silicon, 0.02% or less by weight of carbon, 0.02% or less of sulfur, 0.02% or less by weight of lead, and the remainer being iron. Invar alloy may contain a small amount of chromium or titanium to have smaller strength. The representative composition of Invar alloy is: 64% Fe-36% Ni.

Another Invar-type alloy, usually called "super Invar alloy", is also used as the material of shadow masks. The super Invar alloy consists of 29 to 37% by weight of nickel, 4 to 6% by weight of cobalt, and the remainder being iron. The typical composition of this alloy is: 64% Fe-31% Ni-5% Co.

Further, another Invar-type alloy, which is used in manufacturing shadow masks, is 54% Co-9.5% Cr-36.5% Fe alloy. This alloy consists 53 to 54.5% by weight of cobalt, 9 to 10% by weight of chromium, and the remainder being iron.

Still another alloy is used as the material of shadow masks. This is 50% Fe-42% Ni-5.4% Cr-2.4% Ti. The alloy consists of 40 to 45% by weight of nickel, 4 to 7% by weight of chromium, 2 to 3% by weight of titanium, and the remainder being iron.

Furthermore, an alloy generally known as "Incoloy 903" can be used as the material of shadow masks. Incoloy 903 consists of 35 to 40% by weight of nickel, 13 to 18% by weight of cobalt, 0.5 to 1.5% by weight of aluminum, 2 to 4% by weight of niobium, 1 to 2% by weight of titanium, and the remainder being iron. A representative example of Incoloy 903 has the composition of: 38% Ni-15% Co-0.7% Al-3% Nb-1.4% Ti-rem Fe.

Figure 3:
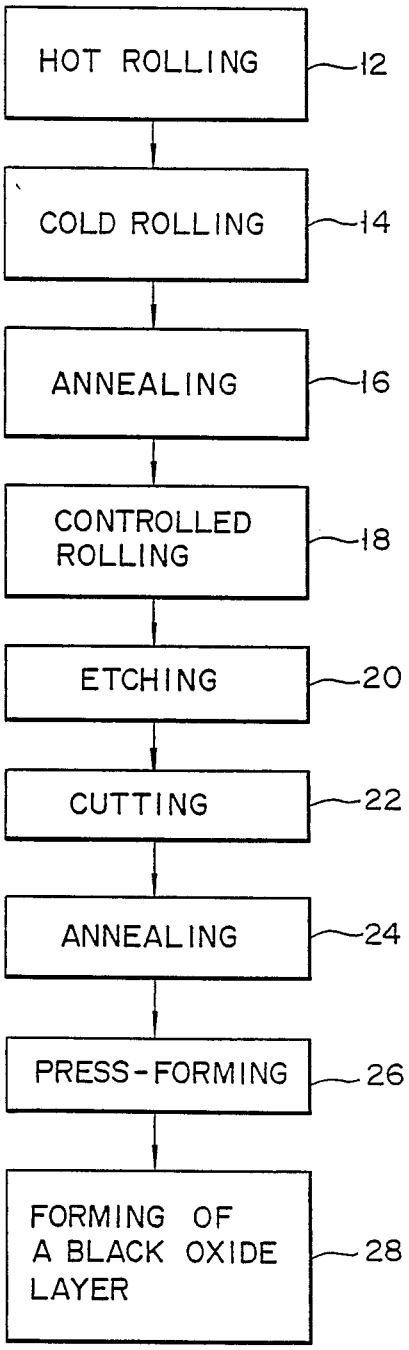
FIG. 3 is a diagram explaining the steps of manufacturing a shadow mask.

It will now explained how a shadow mask is manufactured according to the present invention, with reference to FIG. 3. First, an ingot of an Invar-type alloy or the like is hot-rolled at a temperature of 900° C. or more, thereby forming a plate having a thickness of 2.0 to 4.0 mm (Step 12). This plate cold-rolled at the rolling reduction of 50 to 97%, thus forming a thin, band-like sheet having a thickness of 0.10 to 0.25 mm (Step 14). The sheet is annealed at a temperature over the recrystallization point of the alloy (Step 16). Then, the sheet is subjected to controlled rolling, if necessary (Step 18).

Figure 4:
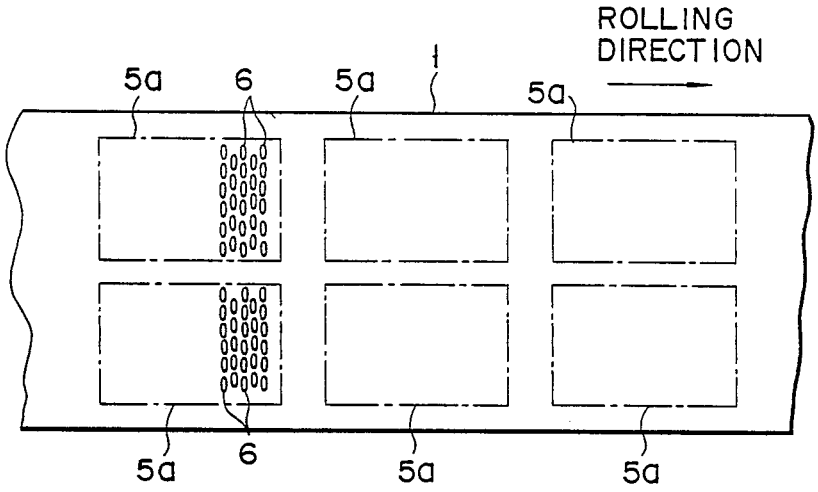
FIG. 4 schematically shows an layout of cutting shadow mask plates from a rolled sheet.
Figure 5:
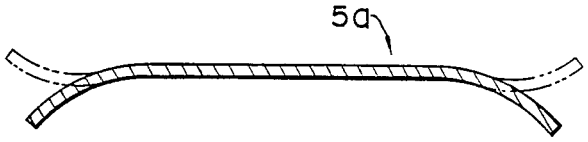
FIG. 5 is a sectional view of a shadow mask plate being pressed, and also a sectional view of the plate deformed due to the springback occurring after the release of stress from the plate.
Figure 6:
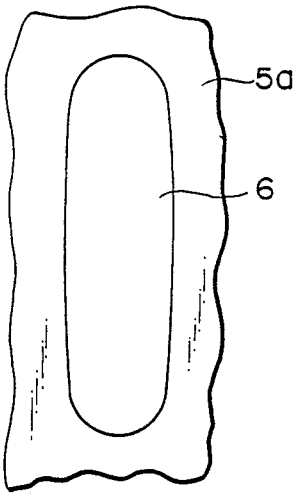
FIG. 6 is an enlarged view of one of the holes of a shadow mask plate before the plate is pressed into a curved form.
Figure 7:
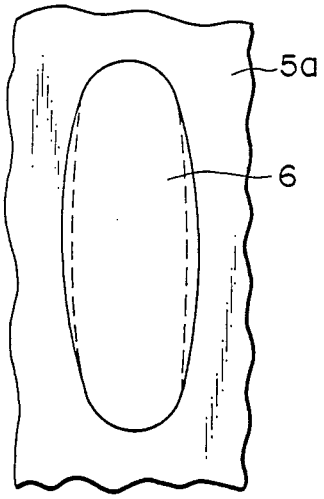
FIG. 7 is an enlarged view of the hole of the shadow mask, which is expanded after the plate has been pressed into a curved form.

Thereafter, both surfaces of the sheet are coated with an etching mask material, thus forming a mask layer having groups of holes, each group consisting of holes having predetermined shape and size and arranged in a prescribed positional relationship. An etching solution is sprayed onto sheet 1, thereby forming groups of elongated holes 6 in sheet 1 to manufacture a shadow mask for use in a 20-inch CRT, each group consisting of 200,000 to 300,000 holes 6. Elongated holes of each group are arranged at the pitch of 0.45 to 0.75 mm (Step 20). As is shown in FIG. 4, the longitudinal axes of these elongated holes 6 extend substantially at right angles to the rolling direction of sheet 1. The angle defined by the longitudinal axes of each elongated hole 6 and the rolling direction of sheet 1 is 90°±10°, preferably 90°±5°.

Figure 2:
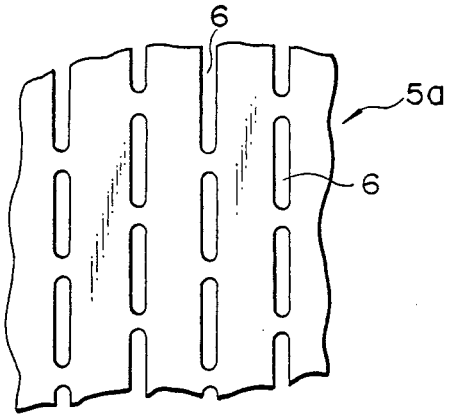
FIG. 2 is an enlarged view of part of a shadow mask having slot-type holes.
Figure 8:
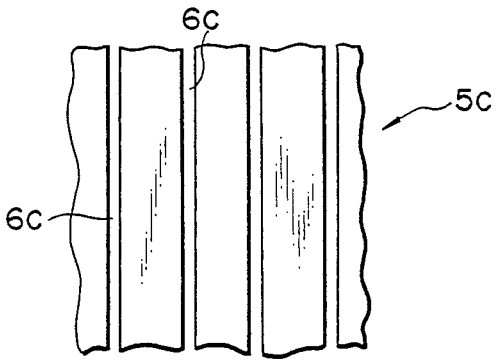
FIG. 8 is an enlarged view of a part of a shadow mask having slit-type holes.

As is illustrated in FIGS. 2 and 8, each elongated hole 6 is either a slot with rounded ends, or a slit with flat ends. The lateral axes of each hole 6 range from 0.15 to 0.16 mm, in the case of a shadow mask for use in a 20-inch CRT.

Rectangular shadow mask plates 5*a* are cut out of sheet 1, each having the long sides extending parallel to the rolling direction of sheet 1, as is illustrated in FIG. 4 (Step 22).

Each of shadow mask plates 5*a* is annealed in vacuum or in a hydrogen atmosphere, at 1000° to 1250° C. for 5 to 40 minutes (Step 24). This annealing reduces the 0.2% proof stress of shadow mask plate 5*a* by 10 to 20 kg/mm$^2$, so that no springback occurs in the subsequent step, i.e., pressing forming (Step 26). When the annealing is performed in vacuum, the degree of vacuum should be $10^{-3}$ to $10^{-6}$ Torr.

Thereafter, shadow mask plate 5*a*, which has been annealed and whose 0.2% proof stress has been reduced, is pressed (Step 26). Press-formed shadow mask plate 5*a* is passed through, for example, a high-temperature water-vapor atmosphere, thereby forming a black oxide layer having a thickness of 0.1 to 2.0 μm on the surfaces of plate 5*a* (Step 28).

In the embodiment described above, the shape of elongated holes 6 can remain unchanged even after shadow mask plate 5*a* has been press-formed. Further, shadow mask plate 5*a* can have a desired shape since it has but a minimum springback. Therefore, it is possible to provide a high-precision shadow mask which causes no doming.

EXAMPLE 1

An ingot of Invar alloy consisting of 36% by weight of nickel and the remainder being iron was hot-rolled into a plate having a thickness of 0.5 mm. This plate was cold-rolled at rolling reduction of 70%, thereby providing a sheet having a thickness of 0.15 mm. The sheet was annealed at 750° C., i.e., a temperature higher than the recrystallization point of the alloy. The sheet was further subjected to controlled rolling. (The controlled rolling is carried only when necessary.) Thereafter, both surfaces of sheet 1 was coated with an etching mask material, thus forming a mask layer having groups of holes, each group consisting of elongated holes 6. An etching solution was sprayed onto sheet 1, thereby forming two groups of elongated holes 6 in sheet 1. As is shown in FIG. 4, holes 6 of each group were so arranged that their longitudinal axes extend at right angles to the rolling direction of sheet 1. Each hole 6 is shaped like a slot, as is shown in FIG. 2. The etching solution was an aqueous solution containing 43% of ferric chloride, 6% of ferrous chloride, and 0.1% of hydrochloric acid, and its temperature was 65° C. when it was sprayed onto sheet 1. Each group of holes consisted of about 300 thousand elongated holes 6. The lateral and longitudinal axes of each hole 6 were 0.15 mm and 0.60 mm. Elongated holes 6 were arranged at the pitch of 0.57 mm long their lateral axes, and at the pitch of 0.73 mm along their longitudinal axes. As is shown in FIG. 2, holes 6 of one column are staggered with respect to holes 6 of either adjacent column.

Then, two rectangular shadow mask plates 5*a* were cut out of sheet 1 such that the long sides of each plate extend parallel to the rolling direction of sheet 1, as is illustrated in FIG. 4.

Thereafter, each shadow mask plate 5*a* was annealed in a reducing atmosphere, i.e., a hydrogen atmosphere, at 1150° C. for 30 minutes, thereby reducing the 0.2% proof stress of the alloy. Table 1, given below, shows the strengths which plate 5*a* had exhibited in the rolling direction and cross direction of sheet 1, before the etching, and also the strengths which plate 5*a* exhibited after the annealing.

TABLE 1

| | before Etching | after Annealing |
|---|---|---|
| Rolling direction | 35.9 (kg/mm$^2$) | 22.8 (kg/mm$^2$) |
| Cross direction | 32.6 (kg/mm$^2$) | 21.3 (kg/mm$^2$) |

As may be evident from Table 1, even after the annealing, plate 5*a* was stronger in its rolling direction than in its cross direction. The strength in the rolling direction was 1.5 kg/mm$^2$ greater than the strength in the cross direction.

Then, shadow mask plate 5*a* was pressed under pressure of about 30 tons. Since the 0.2% proof stress of shadow mask plate 5*a* had been reduced by annealing, plate 5*a* had no springback. In addition, since the lateral axes of slot-shaped holes 6 extended in the rolling direction in which plate 5*a* exhibited greater 0.2% proof stress, they virtually did not increase.

The shadow masks were used in 20-inch color television sets. The screens of these television sets provided images of a very high resolution, and thus very comfortable viewing.

EXAMPLE 2

The same Invar alloy plate as prepared in Example 1 was cold-rolled at rolling reduction of 80%, thereby providing a sheet having a thickness of 0.10 mm. This plate was annealed (Step 16), control-rolled (Step 18), etched (Step 20), and cut (Step 22), in the same way as in Example 1, thereby forming shadow mask plates for use in 20-inch color television sets. These shadow mask plates were identical to those of Example 1, except that they had slit-shaped holes 6*c*, instead of slot-shaped ones, as is illustrated in FIG. 8.

The shadow mask plates were annealed (Step 24), and press-formed (Step 26). Further, a black oxide layer was formed on both surfaces of each shadow mask plate (Step 28), thereby providing shadow masks for 20-inch color television sets.

Table 2, given below, shows the strengths which the shadow mask plates had exhibited before etching (Step 20) in the rolling direction and cross direction, and also the strengths which the plates exhibited after the annealing (Step 24).

TABLE 2

| | before Etching | after Annealing |
|---|---|---|
| Rolling direction | 40.5 (kg/mm$^2$) | 23.1 (kg/mm$^2$) |
| Cross direction | 38.6 (kg/mm$^2$) | 21.5 (kg/mm$^2$) |

As may be evident from Table 2, even after the annealing, the shadow mask plates were stronger in the rolling direction than in the cross direction. More specifically, the strength in the rolling direction was 1.6 kg/mm$^2$ greater than that in the cross direction.

Then shadow masks were used in 20-inch color television sets. The screens of these television sets provided images of a very high resolution, and thus very comfortable viewing.

What is claimed is:

1. A shadow mask made by rolling an ingot comprised of:

an Fe-Ni system alloy having a low expansion coefficient in one direction into a plate, forming a number of elongated holes in the plate, and pressing the plate into a curved form beyond the elastic limit, wherein longitudinal axis of said elongatged holes extend substantially at right angles to the rolling direction of said plate.

2. The shadow mask according to claim 1, wherein said alloy is an Fe-Ni alloy comprising:

34 to 42% by weight of nickel.

3. The shadow mask according to claim 1, wherein said alloy is an Fe-Ni-Co alloy comprising:

29 to 37% by weight of nickel and 4 to 6% by weight of cobalt.

4. The shadow according to claim 1, wherein said alloy is a Co-Cr-Fe alloy comprising: 53 to 55% by weight of cobalt and 9 to 10% by weight of chromium.

5. The shadow mask according to claim 1, wherein the angle defined by the long axis of said elongated holes and the rolling direction of said plate is 90°±10°.

6. The shadow mask made by rolling an ingot of material having a coefficient of thermal expansion less than that of steel, in one direction, into a plate, forming a number of elongated holes in the plate, and pressing the plate into a curved form beyond the elastic limit wherein the longitudinal axis of said elongated holes extend substantially at right angles to the rolling direction of the plate.

7. The shadow mask according to claim 6, wherein the angle defined by the longitudinal axis of said elongatged holes and the rolling direction of said plate is 90°±10°.

8. A method of manufacturing a shadow mask, comprising the step of:

rolling an ingot comprised of an Fe-Ni system alloy having a low expansion coefficient in one direction, thus forming a sheet;

forming a number of elongated holes in said sheet such that the longitudinal axis of the elongated holes extend substantially at right angles to the rolling direction of said sheet;

cutting said sheet, thus forming a plurality of plates each having a group of elongated holes; and pressing these plates into a curved form beyond the elastic limit, thus providing shadow masks.

9. A method of manufacturing the shadow mask according to claim 8, wherein said alloy is an Fe-Ni alloy comprising:

34 to 42% by weight of nickel.

10. A method of manufacturing the shadow mask according to claim 8, wherein said alloy is an Fe-Ni-Co alloy comprising:

29 to 37% by weight of nickel and 4 to 6% by weight of cobalt.

11. A method of manufacturing the shadow mask according to claim 8, wherein said alloy is a Co-Cr-Fe alloy comprising:

53 to 55% by weight of cobalt and 9 to 10% by weight of chromium.

12. A method of manufacturing the shadow mask according to claim 8, wherein the angle defined by the longitudinal axis of said elongaed holes and the rolling direction of said plate 90°±10°.

13. A cathode ray tube for use in a color television set, said cathode ray tube comprising:

an tricolor fluorescent screen for emitting red light, blue light and green light upon receipt of the electron beams; and a shadow mask provided between said electron gun assembly and said tricolor fluorescent screen and having a number of elongated holes through which the electron beams pass, said shadow mask having been made by rolling an ingot of an Fe-Ni alloy in one direction, thereby forming a plate, forming a number of elongated holes in the plate such that the longitudinal axis of these holes extend substantially at right angles to the rolling direction of the plate, and pressing the plate into a curved form beyond the elastic limit.

14. The shadow mask according to claim 13, wherein said alloy is an Fe-Ni alloy comprising:

34 to 42% by weight of nickel.

15. The shadow mask according to claim 13, wherein said alloy is an Fe-Ni-Co alloy comprising:

29 to 37% by weight of nickel and 4 to 6% by weight of cobalt.

16. The shadow mask according to claim 13, wherein said alloy is a Co-Cr-Fe alloy comprising:

53 to 55% by weight of cobalt and 9 to 10% by weight of chormium.

17. The shadow mask according to claim 13, wherein the angle defined by the longitudinal axis of said elongated holes and the rolling direction of said plate is 90°±10°.

18. A shadow mask made by the steps of:

rolling an ingot comprised of a Co-Fe alloy comprising 53 to 55% by weight of cobalt and 9 to 10% by weight of chromium having a low expansion coefficient into a plate;

forming a number of elongated holes into said plate; and pressing said plate into a curved form beyond the elastic limit, wherein the longitudinal axis fo said elongated holes extend substantially at right angles to the rolling direction of said plate.

19. The shadow mask as in claim 18, wherein the angle defined by the long axis of said elongated holes and the rolling direction of said plate is 90°±10°.

20. A method of manufacturing a shadow mask, comprising the steps of:

rolling an ingot comprises of an Co-Fe system alloy of low expansion coefficient in one direction, thus forming a sheet;

forming a number of elongated holes in said sheet such that the longitudinal axis of the elongated holes extend substantially at right angles to the rolling direction of said sheet;

cutting said sheet, thus forming a plurality of plates each having a group of elongated holes; and pressing these plates into a curved form beyond the elastic limit, thus providing shadow masks.

* * * * *